US005761949A

United States Patent [19]

Dalessandro et al.

[11] Patent Number: 5,761,949

[45] Date of Patent: Jun. 9, 1998

[54] DEEP-DRAWN STAMPING PROCESS INCLUDING SIDE PIERCING

[75] Inventors: Ronald M. Dalessandro, Byron Center; Lawrence F. Lorenz, Sr.; Michael H. Carr, both of Holland, all of Mich.

[73] Assignee: Trans-Matic Manufacturing Company, Holland, Mich.

[21] Appl. No.: 803,189

[22] Filed: Feb. 19, 1997

[51] Int. Cl.[6] ..... B21D 28/10; B21D 24/16

[52] U.S. Cl. ..... 72/325; 72/334; 72/335; 72/348

[58] Field of Search ..... 72/335, 333, 327, 72/324, 348, 379.2, 325, 334

[56] References Cited

U.S. PATENT DOCUMENTS

| | | | |
|---|---|---|---|
| 1,040,567 | 10/1912 | Newell | 72/327 |
| 1,672,694 | 6/1928 | Shrum | 72/327 |
| 2,324,468 | 7/1943 | Brickman | 72/325 |
| 2,460,721 | 2/1949 | Thompson | 72/333 |
| 4,395,811 | 8/1983 | Fryet | 72/348 |
| 4,552,005 | 11/1985 | Matsushita | 72/348 |
| 4,621,512 | 11/1986 | Tachikawa | 72/333 |
| 4,669,295 | 6/1987 | Koitabashi | 72/348 |

*Primary Examiner*—Daniel C. Crane

*Attorney, Agent, or Firm*—Warner Norcross & Judd LLP

[57] ABSTRACT

A method for forming a deep-drawn, one-piece, double-walled, cylindrical ring having tabs extending inwardly from the inner wall. The inner wall is formed and pierced to form the tabs. The outer wall is subsequently formed, or completed, to cover the tabs extending from the inner wall. In a preferred embodiment, the tab is formed with a bend by working the inner wall both outwardly and inwardly.

11 Claims, 4 Drawing Sheets

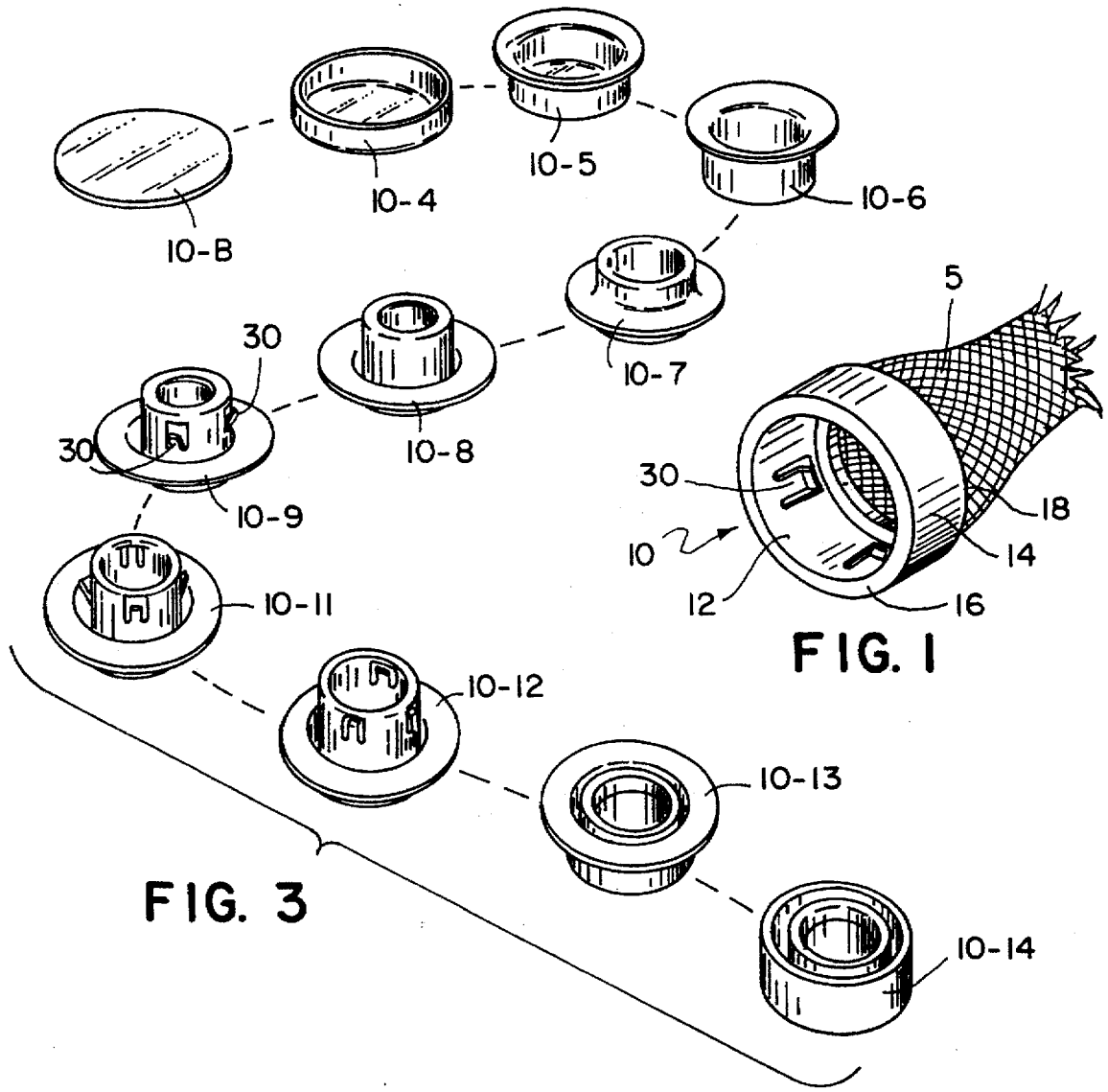
FIG. 1
FIG. 3
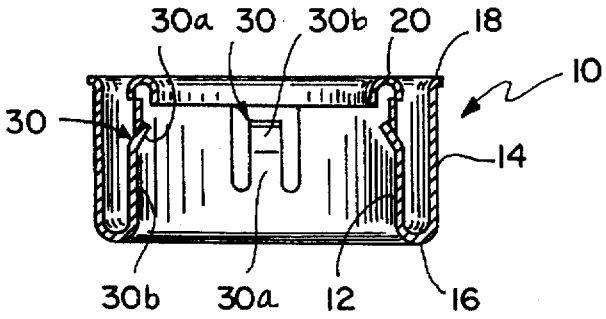
FIG. 2

DEEP-DRAWN STAMPING PROCESS INCLUDING SIDE PIERCING

BACKGROUND OF THE INVENTION

The present invention relates to deep-drawn metal stamping processes and more particularly to such processes permitting side piercing of the stamped objects.

Deep-drawn stamping is a well-developed and well-known art used to fabricate metal parts having significant depth. Initially flat metal stock is transferred through a series of stamping stations. Usually, the process is conducted on a transfer press having the stamping stations and a transfer mechanism for transporting the parts from station to station.

Deep-drawn stamping can be used to fabricate cylindrical objects having double (i.e. inner and outer) walls. However, in known deep-drawn processes, it is not possible to pierce (or otherwise work) either the inner wall or the outer wall because the double-wall structure prohibits simultaneous internal and external radial access to either wall.

SUMMARY OF THE INVENTION

The aforementioned problems are overcome in the present invention, wherein a process is provided for forming a double-wall, cylindrical object in which at least one of the walls is pierced or otherwise worked. More particularly, the process includes partially forming the object to create one of the inner wall and the outer wall, piercing or otherwise working the one wall while the one wall can be accessed internally and externally, and subsequently forming the other wall restricting internal or external access to the pierced wall.

In a preferred embodiments, the one wall is pierced to form a tab. In a further preferred embodiment, the tab is pushed radially inwardly to create a bent tab.

The present invention is a deep-drawn stamping process for forming a double-wall, cylindrical object having a pierced wall portion. The process is straightforward, efficient, and relatively inexpensive.

These and other objects, advantages, and features of the invention will be more fully understood and appreciated by reference to the detailed description of the preferred embodiment and the drawings.

BRIEF DESCRIPTION OF THE DRAWINGS

FIG. 1 is a fragmentary perspective view of a sleeve assembly including a sleeve retainer fabricated in accordance with the process of the present invention;

FIG. 2 is a sectional view through the uncrimped sleeve retainer (i.e. prior to crimping onto the sleeve);

FIG. 3 is a perspective view showing the sleeve retainer after each forming step, or station, in the stamping process;

DETAILED DESCRIPTION OF THE PREFERRED EMBODIMENT

I. Sleeve Retainer

Figure 4:
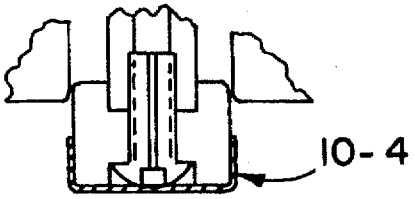
FIG. 4 is the first station drawing.

Oxygen sensors are positioned in the exhaust system of an automotive vehicle to monitor the relationship of fuel and air for optimizing engine performance and emission levels. The wiring harness extending from the oxygen sensor is connected to an on-board computer module. These wires are housed in a flexible, hollow, woven, plastic sleeve. Due to exposure to environmental conditions such as water, stones, and road debris, the sensor and harness must be protected. A metallic ring-shaped retainer is used to secure the flexible sleeve S to the oxygen sensor.

A sleeve retainer fabricated using the process of the present invention is illustrated in FIGS. 1 and 2 and generally designated 10. The retainer is a cylindrical, one-piece, deep-drawn, double-wall object that can be crimped onto the end of a fabric sleeve or hose S. The retainer 10 includes an inner wall 12, an outer wall 14, and a curved connecting portion 16. The free edge 20 of the inner wall 12 curves back into the retainer to facilitate installation of the retainer on a separate component (not shown), such as an oxygen sensor.

The inner wall 12 includes a plurality of integral tabs 30. In the preferred embodiment, four such tabs are included and are equally spaced at 90° intervals around the circumference of the inner wall 12. Each tab 30 includes a connector portion **30*a* integral with and generally parallel to the inner wall 12 and a bent portion 30*b* inclined radially inwardly from the connector portion 30*a*. The tabs 30 provide a retaining function when the retainer 10** is fitted over an object (not shown), such as an oxygen sensor.

II. Stamping Process

The process of the present invention is illustrated in FIGS. 3–14. Although the process is described in conjunction with a sleeve retainer, the process has applicability to wide variety of components. FIG. 3 shows the retainer after processing at each stage or station of the manufacturing process. FIGS. 4–14 illustrate the die sets used at each stage. The die sets are utilized is a conventional transfer press (not shown). The fabrication of the dies and their utilization in a press is well within the ability of one skilled in the art based on the present disclosure.

As previously mentioned, FIG. 3 illustrates the retainer 10 following processing at each station illustrated in FIGS. 4–14. A hyphenated suffix is used in each of the reference numerals in FIG. 3 to illustrate the corresponding figure station number. For example, the designating numeral 10-4 identifies the sleeve 10 as it exits the FIG. 4 station.

Turning to FIG. 3, the designating numeral 10-B identifies the blank from which the retainer is fabricated. The blank is cut from stock supplied to the process from a coil.

The FIG. 4 station operation is referred to as "blank and cup" because it cuts the blank 10-B from the stock and initially forms it into a cup. This station results in the partially formed retainer 10-4.

Figure 5:
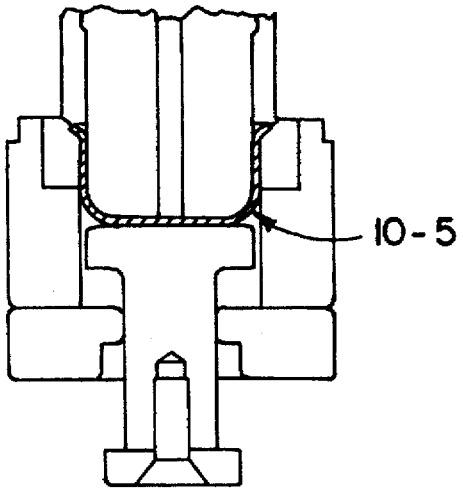
FIG. 5 is the second station drawing.

The FIG. 5 station is the first "drawing," resulting in the partially formed retainer 10-5. Drawing increases the height of the cylindrical wall.

Figure 6:
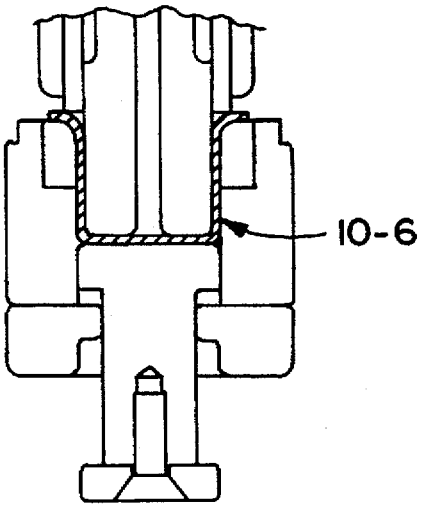
FIG. 6 is the third station drawing.

FIG. 6 illustrates the station in which the "finish draw" is performed resulting in the partially formed retainer 10-6.

Figure 7:
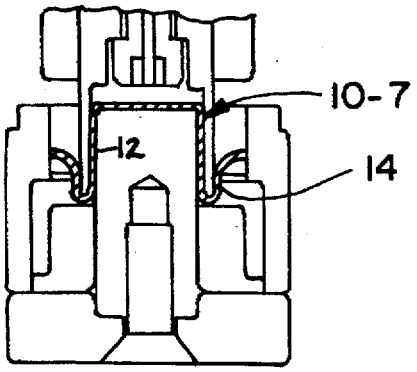
FIG. 7 is the fourth station drawing.

FIG. 7 illustrates the first "reverse draw" station in which the inner wall 12 is partially formed resulting in the partially formed retainer 10-7. This station is referred to as reverse drawing because the closed end of the cylindrical material is drawn upwardly inside the drawn outer wall 14.

Figure 8:
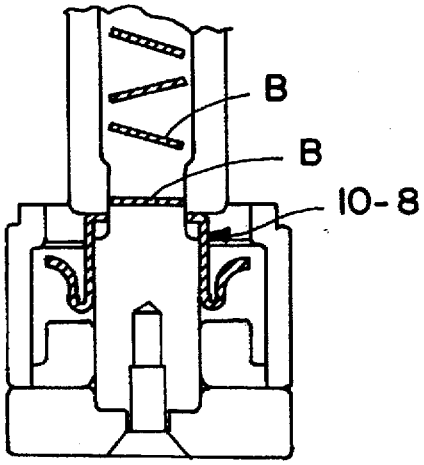
FIG. 8 is the fifth station drawing.

FIG. 8 illustrates the "bottom pierce" station wherein the bottom B is removed from the piece resulting in the partially formed retainer 10-8. The removed bottoms B are discarded.

Figure 10:
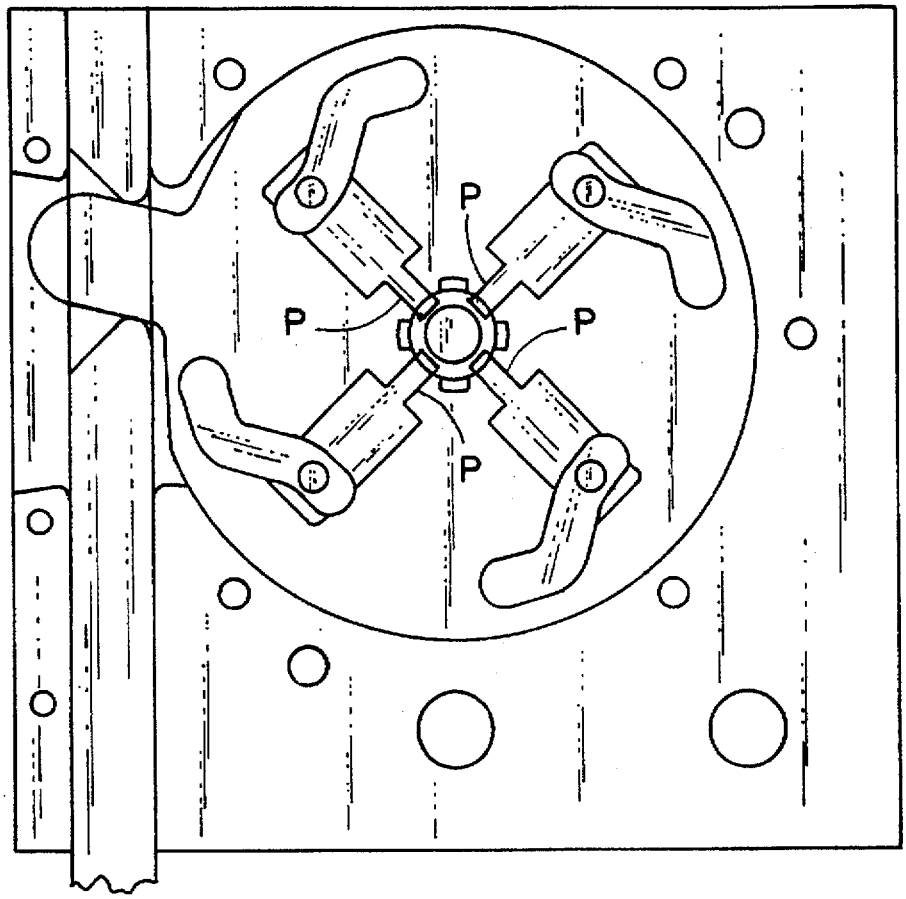
FIG. 10 is a plan view of the FIG. 9 piercing apparatus.
Figure 9:
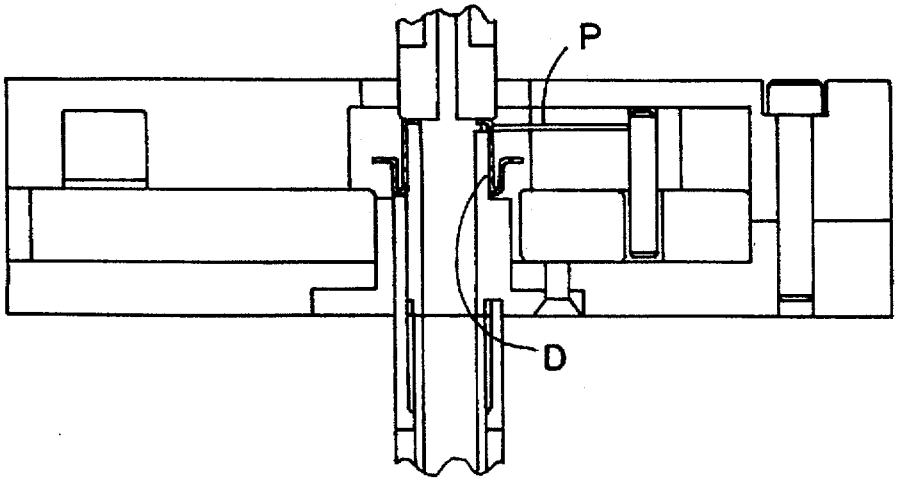
FIG. 9 is the sixth station drawing.

FIG. 9 illustrates the "side pierce" station, and FIG. 10 is a plan view of the cam-actuated piercing mechanism in that station. As shown in FIG. 9 and at 10-9 in FIG. 3, a portion of the inner wall 12 of the sleeve may be freely radially accessed from both the interior and exterior sides of the wall. Such free access permits metal working operations to be performed on the inner wall at this point. Specifically as illustrated in FIG. 9, the inner wall is pierced to form tabs 30. Access to the interior side of the wall is important to support the inner wall during piercing. Access to the outside of the wall is necessary to enabling the piercing punch to extend through the wall.

As illustrated in FIGS. 9 and 10, the punches P are cam-actuated. The punches P are extended radially inwardly after the support die D has been inserted into the piece. While the punching operation removes material, leaving the tabs 30 defined. The punches P first push radially inwardly to form the tabs and then is pulled outwardly. The tabs 30 are pulled outwardly from the inner wall as the punches P are retracted resulting in the outwardly extending tabs 30 of the partially formed retainer 10-9.

Figure 11:
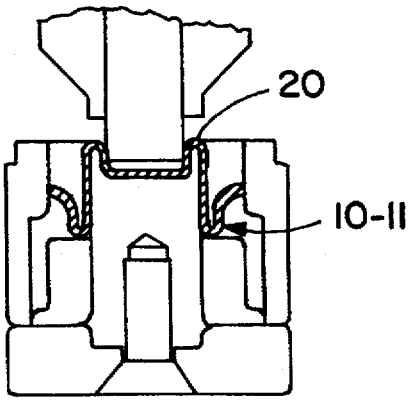
FIG. 11 is the seventh station drawing.

FIG. 11 illustrates the "extrude" step wherein the free end of the inner wall is curved inwardly to produce the rounded edge 20 (see FIG. 2 also), resulting in the partially formed retainer 10-11.

Figure 12:
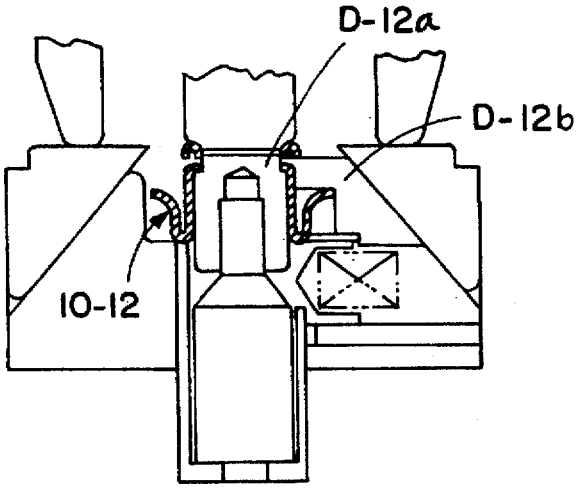
FIG. 12 is the eighth station drawing.

FIG. 12 illustrates the "tab form" operation wherein the tabs are bent inwardly from the inner wall 12. The cam-actuated die pushes the tabs radially inwardly. The supporting die D-12*a* and pushing die D-12*b* cooperate to form the bend in the tab that separates the connector portion 30*a* and the bent portion 30*b* (see also FIG. 2).

Figure 13:
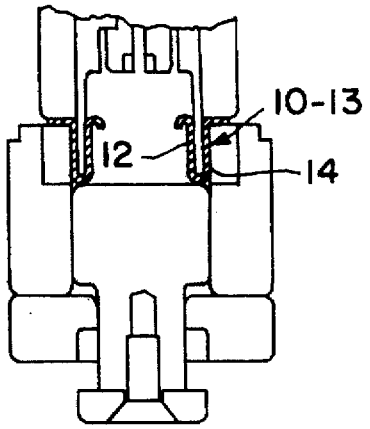
FIG. 13 is the ninth station drawing.

FIG. 13 illustrates the "re-reverse draw" step wherein the inner wall 12 is re-drawn to the same height as the outer wall 14. This step completes the re-reverse process resulting in the partially formed piece 10-13 wherein the inner and outer walls are axially coextensive. After this step, the outer wall prohibits free radial access to the outer side of the inner wall.

Figure 14:
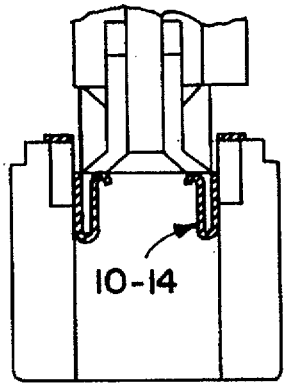
FIG. 14 is the tenth station drawing.

Finally, FIG. 14 illustrates the "trim out" station wherein the waste flange is removed from the free end of the outer wall 14 resulting in the finished product 10 or 10-14.

The present invention provides a metal-forming process for forming a double-wall cylindrical object and for performing metal-forming operations on either or both of the cylindrical walls. The present invention therefore permits the fabrication of a wide range of metal components not previously possible, or possible only with significant difficulty. Therefore, the present invention enables a broader range of components to be fabricated more efficiently and less expensively than previously known in the art.

The above description is that of a preferred embodiment of the invention. Various changes and alterations can be made without departing from the spirit and broader aspects of the invention as defined in the appended claims, which are to be interpreted in accordance with the principles of patent law, including the doctrine of equivalents.

The embodiments of the invention in which an exclusive property or privilege is claimed are defined as follows:

1. A method of forming a deep drawn, one-piece, double-walled, cylindrical object having a piece extending radially from an area of an inner wall, the piece being covered by an outer wall, said method comprising the steps of:

forming a blank into a cup shape having a rim, a floor, and a wall extending between the rim and the floor;

reverse drawing the cup shape so that the floor of the cup shape passes through and beyond the rim creating an intermediate shape having the inner wall and an outer wall, the area of the inner wall extending beyond said rim to provide internal and external radial access to the area of the inner wall;

forming the piece from the area of the inner wall; and re-reverse drawing the rim of the cup to further form the outer wall and to draw the outer wall over the area of the inner wall, whereby the outer wall restricts external radial access to the area of the inner wall and therefore restricts access to the piece extending from the inner wall.

2. A method of forming a deep drawn, one-piece, double-walled, cylindrical object having a piece extending radially from an area of an inner wall, the piece being covered by an outer wall, said method comprising the steps of:

partially forming the object creating the inner wall with internal and external radial access to the area of the inner wall;

forming the piece from the area of the inner wall including piercing the inner wall; and subsequently forming the outer wall over the area of the inner wall and therefore over the piece extending from the outer wall.

3. A method as defined in claim 2 wherein said piece is first pulled radially outwardly and second pushed radially inwardly.

4. A method of forming a deep drawn, one-piece, double-walled, cylindrical object having a piece extending radially from an area of an inner wall, the piece being covered by an outer wall, said method comprising the steps of:

partially forming the object creating the inner wall with internal and external radial access to the area of the inner wall;

forming a portion of the outer wall, the portion not covering the area of the inner wall from which the piece will be formed;

forming the piece from the area of the inner wall; and subsequently forming the outer wall over the area of the inner wall and therefore over the piece extending from the outer wall.

5. A method of forming a deep-drawn, one-piece, cylindrical, double-walled object comprising the steps of:

forming a cup having a floor and a rim;

pushing the floor through and beyond the rim to partially form the inner and outer walls, the portion of the inner wall extending beyond the rim being an area of the inner wall with internal and external radial access;

forming an integral piece in the area of the inner wall extending beyond the rim; and subsequently pulling the rim toward the floor to further form the outer wall and to radially cover the integral piece in the area of the inner wall with the outer wall.

6. A method as defined in claim 5 further comprising forming a portion of the other wall prior to said piece-forming step, the portion not radially covering the portion of the one wall from which the piece is formed.

7. A method as defined in claim 5 wherein said piece-forming step includes moving the piece both radially inwardly and radially outwardly.

8. A method as defined in claim 5 wherein the one wall is the inner wall.

9. A method of forming a deep-drawn, one-piece, cylindrical, double-walled object comprising the steps of:

forming one of the inner and outer walls;

forming an integral piece in the one wall, including piercing the one wall; and subsequently forming the other of the inner and outer walls so as to radially cover the integral piece.

10. A method of manufacturing a one-piece metal ring having inner and outer walls and tabs extending radially inwardly from the inner wall, said method comprising the steps of:

forming a cylindrical inner wall having opposite edges and a flange extending generally perpendicularly from one of the edges, whereby the inner wall can be accessed radially from both the interior and exterior of the inner wall;

forming a tab in the inner wall by piercing the inner wall, pulling a portion of the tab radially outwardly, and subsequently pushing the tab radially inwardly; and subsequently forming a cylindrical outer wall from the flange so that the outer wall overlies the inner wall, is spaced from the inner wall, and is concentric with the inner wall.

11. A method as defined in claim 10 further comprising partially forming the outer wall prior to said tab-forming step.

* * * * *